United States Patent [19]

Mikami et al.

[11] 4,295,809

[45] Oct. 20, 1981

[54] DIE FOR A MELT BLOWING PROCESS

[75] Inventors: Takashi Mikami; Shigeo Fujii; Shuji Okano; Tokuzo Ikeda, all of Ooi, Japan

[73] Assignee: Toa Nenryo Kogyo Kabushiki Kaisha, Tokyo, Japan

[21] Appl. No.: 75,816

[22] Filed: Sep. 14, 1979

[51] Int. Cl.[3] ..... D01D 3/00

[52] U.S. Cl. ..... 425/72 S; 264/12; 264/518; 425/141; 425/464

[58] Field of Search ..... 425/464, 72 S; 264/13, 264/DIG. 75, 518

[56] References Cited

U.S. PATENT DOCUMENTS

| | | | |
|---|---|---|---|
| 2,433,000 | 12/1947 | Manning | 264/DIG. 75 |
| 3,379,811 | 4/1968 | Hartmann et al. | 425/464 |
| 3,478,389 | 11/1969 | Bradley et al. | 425/464 |
| 3,825,379 | 7/1974 | Lohkamp et al. | 425/464 |
| 3,825,380 | 7/1974 | Harding et al. | 425/464 |
| 3,836,305 | 9/1974 | Grazene | 425/464 |
| 3,970,417 | 7/1976 | Page | 425/72 S |
| 4,021,167 | 5/1977 | Niimi et al. | 264/13 |
| 4,183,881 | 1/1980 | Griffin et al. | 264/13 |

FOREIGN PATENT DOCUMENTS

| | | |
|---|---|---|
| 44-25871 | 10/1969 | Japan . |
| 44-26977 | 10/1969 | Japan . |
| 51-67411 | 6/1976 | Japan . |

OTHER PUBLICATIONS

"Superfine Thermoplastic Fibers", Wente, Ind. Eng. Chem., vol. 48, No. 8, pp. 1342–1346, Aug. 1956.

*Primary Examiner*—Jay H. Woo

*Attorney, Agent, or Firm*—W. T. Clarke; M. B. Kurtzman

[57] ABSTRACT

In an improved die-nose assembly for a melt-blowing process wherein molten resin is extruded from a series of die-holes while heated gas is blown out through slots on either side of the die nose associated therewith, spacers which are movable widthwise of the die assembly are provided in the gas slots to provide effective uniformity in the gas streams across the width of the die.

16 Claims, 13 Drawing Figures

FIG. 5
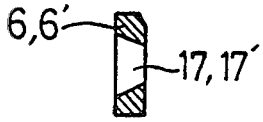
FIG. 6
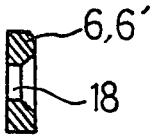
FIG. 7
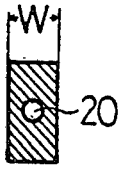
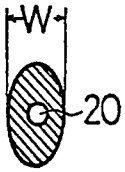
FIG. 8
FIG. 9
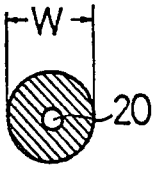
FIG. 10
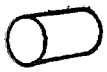
FIG. 11
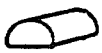
FIG. 12
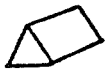
FIG. 13
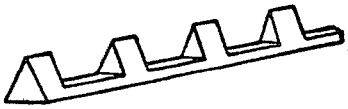

DIE FOR A MELT BLOWING PROCESS

This invention relates to an improvement in spinning dies, in particular, dies used for the production of nonwoven fabrics by means of a melt-blowing process. More particularly, the present invention is concerned with an improvement in dies used for the process of producing nonwoven fabrics or cloth which comprises extruding a melted thermoplastic resin through a plurality of resin extrusion holes provided on the projecting part of a nozzle piece with a triangular cross section, simultaneously passing a gas stream at high speed out from gas slots provided at both sides of the spinning holes, thereby forming the thermoplastic resin fibers into a fiber stream consisting of fine fibers and the high speed gas, and then recovering the fiber stream on a moving collecting surface. Such a process is called a "melt-blowing process" (Japanese Patent Application (OPI) Nos. 10,258/1974, 48,921/1974, 121,570/1975 and 46,972/1975) or "jet spinning process" (Japanese Patent Publication Nos. 25,871/1969 and 26,977/1969).

The nonwoven fabrics obtained by the prior art process as described above are porous nonwoven fabrics made of fibers having a diameter of 0.5 to 20 microns, which have been widely used, for example, as separators in lead storage batteries, as filters, as medical masks, as artificial leather, etc. The pore size of the nonwoven fabric can be chosen within a wide range depending upon the object of use.

When a thin nonwoven fabric is produced by the prior art process, however, pinholes are often formed which lower the worth as an article of commerce and render the particular part useless.

The inventors have found that in the prior art processes for the production of nonwoven fabrics, the thermoplastic resin extruded from a die hole is not continuously formed into a fiber but adheres to the die around the extrusion hole, or the intermediate part of the fiber is often formed into a glob, and when this glob is blown against a collecting plate, not only the resulting nonwoven fabric is uneven, but also the collected fibers in the nonwoven fabric are sometimes melted by heat to cause pinholes. It has further been found that such a phenomenon is due to the unevenness in the flow rate, flow quantity and width of the gaseous stream blown out at a high speed near the speed of sound from the gas slots provided at both sides of the extrusion holes simultaneously with the extrusion of thermoplastic resin from the extrusion holes, which unevenness etc., is caused by the unevenness in the gap of the gas slots.

Unless in a spinning die for producing a nonwoven fabric, the gap of gas exhaust slots at both sides of the resin extrusion holes in the projecting part of the die is controlled with an accuracy within a range of $\pm 10\%$ of a predetermined value over the whole width of the die, a gas stream blown at high speed from the gas slots will be uneven, so that the spun fibers are not smoothly stretched, globular parts are formed in the intermediate part of the fiber, or fibers are not well formed due to adhesion or deposition. In order to prevent this, it is necessary to make the flow rate, flow quantity and width of a jet stream blown at a speed near the speed of sound from both sides of extrusion holes in the projecting part of the die, uniform. If the balance of jet streams at both sides of the projecting part of the die is upset, small swirls appear at the projecting part of the die and the spinning condition is unstable, resulting in the disadvantages as set forth above.

As apparent from the foregoing illustration, it is very important to control the gap of a gas slot at the projecting part of an extrusion die, but in the prior art die, even if the dimension of the gap of a gas exhaust slot is precisely controlled at normal temperature, the predetermined value cannot be held with high accuracy because deformation occurs due to heat strain during operation.

For the purpose of solving these problems, the inventors have made further studies on the provision of the gap of a gas exhaust slot with a spacer and consequently, have found that the use of a fixed spacer with a large contact area with the nozzle piece is not effective for holding a predetermined gap value at normal temperature with high accuracy against thermal deformation during operation.

However, in accordance with the invention, an extrusion die suitable for the production of nonwoven fabrics in stable manner for a long period of time can be obtained in which the dimension of the gap or interval of the gas exhaust slots can be held and controlled with high accuracy by the provision of a spacer for determining the gap of a gas exhaust slot which spacer (which will hereinafter be referred to as "spacer" simply) is slidable or movable and brought into contact with the nozzle piece substantially at one point in cross-section.

FIG. 5 is a sectional view along Y—Y of FIG. 3 or Y'—Y' of FIG. 4;

FIG. 6 is a sectional view along Z—Z of FIG. 3 or Z'—Z' of FIG. 4;

FIGS. 7, 8 and 9 are sectional views along X—X of FIG. 2 of the spacers for determining the set back; and FIGS. 10, 11, 12 and 13 are perspective views of spacers for determining the gap of a gas exhaust slot.

The present invention provides an extrusion die, in which the nozzle piece is a projecting part having a substantially, triangular cross-section, the projecting part having resin extrusion holes opening on the apex edge thereof. A pair of gas lips are provided at a predetermined gap or interval on both sides of the triangular nozzle piece to form gas exhaust slots, and slidable or movable spacers are provided in the gas exhaust slots, the assembly being suitable for the production of nonwoven fabrics.

Figure 1:
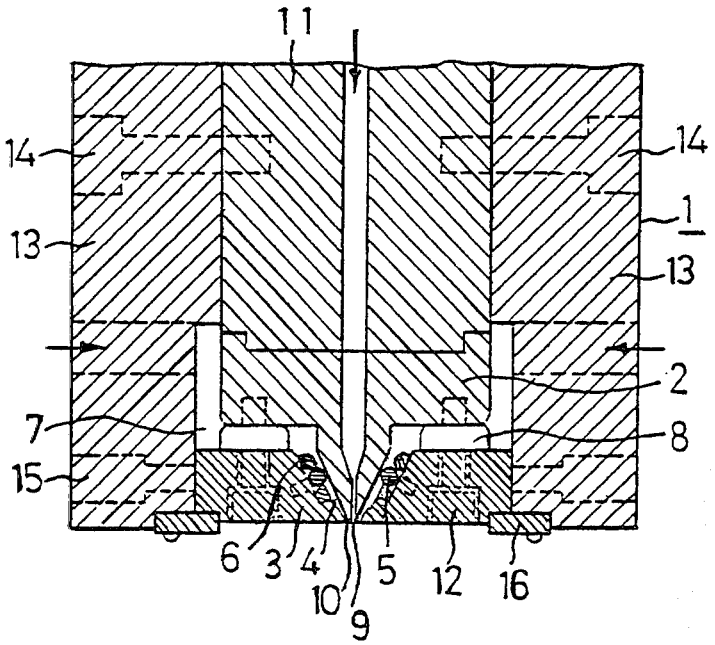
FIG. 1 is a cross sectional view of an extrusion die according to the present invention.
Figure 2:
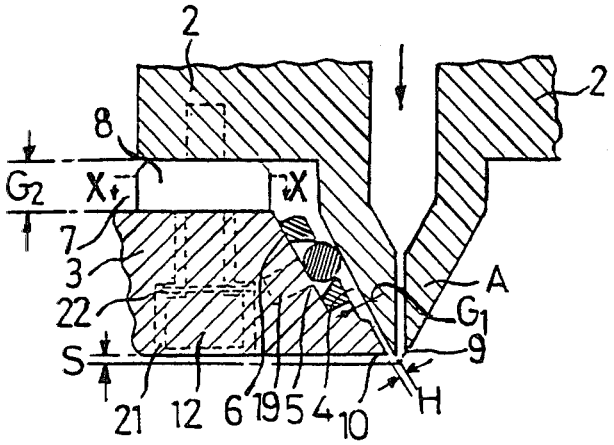
FIG. 2 is an enlarged view of the projecting part of the die shown in FIG. 1.

Referring now to the accompanying drawings in detail:

FIG. 1 and FIG. 2 are cross sectional views of die assembly 1 according to the present invention. Spherical spacer 5 is fitted to gas lip 3 by push plate 6. A pair of gas lips 3 are fixed by bolt 12 to nozzle piece 2 through spacer 8 which determines "set back" S (Cf. FIG. 2). Nozzle piece 2 is connected with die part 11 which is surrounded by a pair of casings 13 fixed by bolts 14. Gas lip 3 provided with spherical spacer 5 is pushed by push and draw bolt 15 or another push bolt with a spring so that globular spacer 5 may be in contact with nozzle piece 2 to determine dimension H (Cf. FIG. 2) of the gap of gas exhaust slot end 10. The gap between gas lip 3 and casing 13 is sealed by soft packing material 16.

Figure 3:
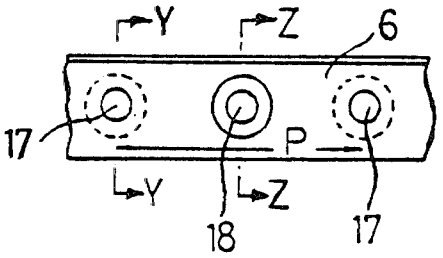
FIG. 3 is a front view, partly cut away, of a push plate for fitting a globular spacer.
Figure 4:
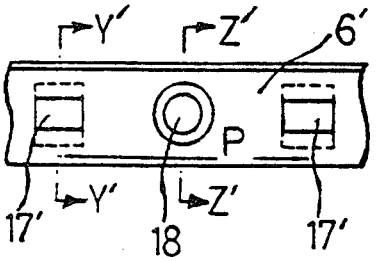
FIG. 4 is a front view, partly cut away, of a push plate for fitting a spacer with each shape shown in FIG. 10, 11 or 12.

Spherical spacer 5 is generally made of a rigid material, in particular, having a particularly high rigidity, such as metals, ceramics, synthetic ruby and the like. The diameter of spacer 5 is selected depending upon the desired dimension H of the gap of gas exhaust slot end 10. Spherical spacer 5 is fitted into push plate 6 made generally of a metal and having spacer holding pole 17 as shown in FIGS. 3 and 5 and push plate fixing tapped hole 18 as shown in FIG. 4 and FIG. 6. The spacers are arranged linearly in parallel with the gas exhaust slot end in the width direction of the die. Push plate 6 is fixed to air lip 3 by flat head screw 19 in such a manner that the screw head is completely buried in the push plate 6. Pitch P for fitting spherical spacer 5 is so determined that the flow rate of a gas jet stream exhausted from both sides of extrusion holes at the projecting part of the die is not disturbed, while the effect of the spacer is obtained. Pitch P is preferably 20 times the width $G_1$ of gas exhaust slit 4. Spacer holding hole 17 of push plate 6 has a slope expanded from the surface to the part of dotted line as shown in FIG. 3 and FIG. 5 and holds spherical spacer 5 at a somewhat upper portion from the center of the cross section shown in FIG. 2 so that it is prevented from falling off and it is readily slidable or movable.

Spacer 8 for determining set back S has a shape as shown in FIG. 7, 8 or 9 which can optionally be chosen depending on the object, and is fixed to nozzle piece 2 by bolt 12 through bolt hole 20 and bolt hole 21 of gas lip 3 in the gas feed path between gas lip 3 and nozzle piece 2 to thus determine set back S with high accuracy. Bolt hole 21 of gas lip 3 has a space for bolt 12 and, optionally, metallic or heat resisting packing material 22 is used between gas lip 3 and bolt 12. Therefore, even if the die is subject to thermal deformation, sliding of nozzle piece 2 and gas lip 3 is possible, in particular, in the width direction of the die. The height of spacer 8 for determining set back S is determined by the desired value of set back S, and the width W thereof is equal to or less than the height $G_2$ of gas feed path 7 (Cf. FIG. 2). In addition, spacer 8 should be fitted in such a direction that the longitudinal direction thereof is perpendicular to the width direction of the die (arrangement direction of resin extrusion holes 9), except in the case of circles, and in such an interval that the disturbance of the flow rate of a gaseous jet stream exhausted from the both sides of extrusion holes 9 of the projecting part of the die can be neglected, the interval being preferably 5 times the width W of spacer 8 for determining set back S.

In the above described embodiment of the present invention, a spacer for defining the gap of a gas exhaust slot, having a spherical shape, is used, but any other shape can be used that is contacted with nozzle piece 2 substantially at one point in cross section, as shown in FIGS. 10, 11 12 and 13. "Substantially at one point" used in this specification means a length of 1/10 of one side of the triangular portion of the cross-section of nozzle piece 2. The spacer of such a shape should have a length less than two times the width $G_1$ of gas exhaust slot 4 so as to prevent the jet stream exhausted from both sides of spinning holes 9 from disturbance of the flow rate, and the fitting direction of the spacer is preferably in parallel with the width direction of the die. Fitting of the spacer is carried out by using spacer holding hole 17' of push plate 6' for fitting a spacer as shown in FIG. 4 and fitting in an analogous manner to that of a spherical form in the case of the forms as shown in FIGS. 10, 11 and 12, and by fixing push plate 6 to gas lip 3 using flat head screws through cut portions in the case of the shape as shown in FIG. 13.

As set forth above, according to the spinning die of the present invention, suitable for the production of nonwoven fabrics, not only the dimension of the gap of a gas exhaust slot and the dimension of the set back can be controlled with high accuracy over the whole width of the die, but also the predetermined value at normal temperature can be held with high accuracy because the change of the contact position can be minimized by sliding or movement of the spacer or by point or line contact of the spacer with the nozzle piece even if the whole body of the die is subject to a large heat deformation at the start of operation. Furthermore, control of these dimensions can readily be carried out during operation and it is thus made possible to produce a nonwoven fabric under stable spinning state for a long time. The present invention is applicable to, in addition to the die structures according to these embodiments, another structure in which the end of a gas exhaust slot precedes the extrusion hole of the projecting part of a die, for example, disclosed in Japanese Patent Publication No. 25,871/1969 and Japanese Patent Application (OPI) No. 67,411/76.

What is claimed is:

1. An extrusion die assembly for a melt blowing process with a nose piece having a triangular cross-section and extrusion holes along the apex thereof, for extrusion of melted thermoplastic resin, said assembly having gas lips defining gas slots at either side of the apex and having movable spacers provided in the gas slots said spacers contacting said nose piece and said gas lips for determination of the gap of the gas slots.

2. A die according to claim 1 wherein the spacers are slidable.

3. A die according to claim 1 wherein the spacers are movable with the gas lips.

4. A die according to claim 1 wherein the spacers are of a cross-section such that they contact the die nose substantially at one point.

5. A die nose according to claim 1 wherein the spacers are spherical.

6. A die nose according to claim 1 wherein the spacers are cylindrical.

7. A die nose according to claim 1 wherein the spacers are triangular prisms.

8. A die nose according to claim 1 wherein the spacers are made of metal, ceramics, synthetic ruby etc.

9. A die nose according to claim 1 wherein a plurality of spacers are provided in each gas slot spaced from each other along the width of the die.

10. An extrusion die for a melt blowing process with a nose piece having a triangular cross-section and extrusion holes along the apex thereof, said die assembly having gas lips defining gas slots at either side of the nose piece and having a plurality of movable spacers in each gas slot spaced from each other along the width of the die, wherein the spacers are movable with the gas lips and have a cross-section such that they contact the die nose substantially at one point.

11. A die nose according to claim 10 wherein the spacers are spherical.

12. A die nose according to claim 10 wherein the spacers are cylindrical.

13. A die nose according to claim 10 wherein the spacers are triangular prisms.

14. A die nose according to claim 10 wherein the spacers are made of metal, ceramics, synthetic ruby etc.

15. A die nose according to claim 1 wherein the spacers are made of metal, ceramics, or synthetic ruby.

16. A die nose according to claim 10 wherein the spacers are made of metal, ceramics, or synthetic ruby.

* * * * *